US009157289B1

(12) United States Patent
Bair et al.

(10) Patent No.: US 9,157,289 B1
(45) Date of Patent: Oct. 13, 2015

(54) HYDRAULIC ANCHOR FOR OILFIELD SERVICE AND METHOD OF USING THE SAME

(71) Applicant: Black Gold Pump and Supply, Inc., Signal Hill, CA (US)

(72) Inventors: Michael Bair, Los Angeles, CA (US); Andrew Tillison, Los Angeles, CA (US)

(73) Assignee: BLACK GOLD PUMP AND SUPPLY, INC., Signal Hill, CA (US)

( * ) Notice: Subject to any disclaimer, the term of this patent is extended or adjusted under 35 U.S.C. 154(b) by 262 days.

(21) Appl. No.: 14/029,542

(22) Filed: Sep. 17, 2013

(51) Int. Cl.
*E21B 23/01* (2006.01)

(52) U.S. Cl.
CPC ..... *E21B 23/01* (2013.01)

(58) Field of Classification Search
CPC ..... E21B 23/00; E21B 23/01
See application file for complete search history.

(56) References Cited

U.S. PATENT DOCUMENTS

| | | | | |
|---|---|---|---|---|
| 4,901,793 | A * | 2/1990 | Weber | 166/68.5 |
| 6,073,693 | A * | 6/2000 | Aldridge | 166/217 |
| 6,241,017 | B1 * | 6/2001 | Doane et al. | 166/134 |
| 6,431,277 | B1 * | 8/2002 | Cox et al. | 166/208 |
| 2008/0135261 | A1 * | 6/2008 | McGilvray et al. | 166/382 |
| 2012/0037381 | A1 * | 2/2012 | Giroux et al. | 166/382 |

* cited by examiner

*Primary Examiner* — William P Neuder
(74) *Attorney, Agent, or Firm* — James M. Duncan, Esq.

(57) ABSTRACT

A hydraulic tubing anchor used in hydrocarbon producing wells has structure which positively contains a live slip within the mandrel of the anchor, thereby preventing the live slip from separating from the tubing anchor and dropping deeper into the well. Structure at the ends of the live slip engage within corresponding grooves of the slip recess.

18 Claims, 9 Drawing Sheets

HYDRAULIC ANCHOR FOR OILFIELD SERVICE AND METHOD OF USING THE SAME

BACKGROUND OF THE INVENTION

This invention relates to devices for anchoring a tubing string to a surrounding well casing. Tubing anchors have a variety of uses in oilfield operations. For example, when an oil well is produced with a downhole rod pump, during the pumping cycle the weight of the fluid in the tubing string shifts between a load on the rod string on the upstroke to a load on the tubing on the downstroke. For installations which do not have an anchor, during the downstroke the weight of the fluid in the tubing causes the tubing to stretch, but on the upstroke the load is transferred to the rod string so the tubing contracts. In an unanchored installation, this cycle causes wear in the rods and tubing because of the rubbing of the rods and rod boxes against the inner wall of the tubing. In unanchored installations the pump efficiency is decreased by the decrease in the effective stroke length.

A tubing anchor maintains the tubing in tension, thereby lengthening the effective stroke length of the pump and preventing the stretching/contracting cycle of the tubing string. Tubing anchors generally operate by the urging of slips against the interior wall of the production casing of the well by the application of mechanical or hydraulic force. Anchors which are activated hydraulically typically have a "live slip" or "floating slip" (hereinafter "live slip") which is urged outwardly against the interior of the casing wall upon the application of hydraulic pressure to a piston which drives the live slip radially outward. The piston may have a relatively large diameter and is capable of providing a substantial applied force to the live slip thereby maintaining the position of the anchor in the casing and keeping the tubing string in tension.

When tubing needs to be pulled from the well, the tubing anchor needs to be released. The releasing procedures usually involve pulling up on the tubing string or rotating the tubing string. However, during this process, it is not uncommon for the live slip or other anchor components to separate from the tubing anchor and fall downhole, either to the well bottom or to be stopped by casing restrictions or by a smaller diameter casing/liner below the set point of the anchor. The loss of the live slip downhole is problematic. Anchor slips are typically manufactured from hardened steel and can form an obstruction requiring an expensive fishing job or, alternatively, can be left downhole with the potential for causing problems in the future.

SUMMARY OF THE INVENTION

Embodiments of the method and apparatus disclosed herein provide a solution to the disadvantages described above. For purposes of this disclosure, the terms "lower," "bottom," "downward," etc., refer to a direction facing toward the bottom of a well and the terms "upper," "top," "up," etc., refer to a direction facing toward the surface. The terms "inward" and "inwardly" refer to a direction facing toward the central axis of the disclosed hydraulic anchor and the terms "outward" and "outwardly" refer to a direction facing towards the inside wall of the casing string.

An embodiment of the apparatus is utilized in hydrocarbon producing wells for anchoring a tubing string within a length of well casing, where the apparatus restrains axial (i.e., upward and downward) motion of the tubing string. Embodiments of the apparatus have a mandrel which is made up into the tubing string, typically with the mandrel having threaded ends on each end which are made up into tubing couplings. The mandrel has an upper end, a lower end, and a plurality of axially oriented (i.e., aligned along the long axis of the mandrel from end-to-end) slip recesses spaced circumferentially about the mandrel. There are at least two different types of slip recess. One type will have a fixed slip mounted within the recess. The second type of slip recess is a live slip recess, which has disposed within it, or extending from it, a live slip. It is to be understood from the disclosure and claims below that statements that the live slip is "disposed within" the live slip recess refer to the live slip being contained within the live slip recess when the anchor is an uninstalled configuration, but once the live slip is set by application of hydraulic force, a portion of the live slip will radially extend outside of the live slip recess and grip against the interior wall of the casing, placing the anchor in an installed configuration. Unless stated otherwise, descriptions and claims which provide that the live slip is "disposed within the live slip recess" apply to both the installed and uninstalled configuration as described above.

The live slip recess has an upper end and a lower end (relative to the upper end and lower end of the mandrel), a first groove in the upper end and a second groove in the lower end. The first groove has a first width, which refers to the dimension from an inward wall, with respect to the central axis of the mandrel, to an opposing outside wall. Likewise, the second groove has a second width, again referring to the dimension from an inward wall to an opposing second wall. The first width and second width may have the same dimension. The first wall may be defined by a flat portion at the innermost portion of the live slip recess. Alternatively, the first wall may be defined by a shoulder member outward of the flat portion.

The live slip has a top end and a bottom end, which respectively correspond to the upper end and lower end of the live slip recess. The top end of the live slip has an axially tab. Likewise, the lower end also has an axially extending tab. When the live slip is disposed within the live slip recess, the tab at the top end is disposed within the first groove and the tab at the lower end is disposed within the second groove. The tabs at the top end and bottom end have a thickness, which may be the same. It is to be appreciated that the range of travel of the live slip in an outward direction (i.e., away from the central axis of the mandrel) is defined by the differences between the widths of the grooves and the thicknesses of the tabs. That is, once the outward facing surfaces of each tab engage the outer (second) wall of the groove, the live slip is restricted from any further outward travel. However, the engagement face of the live slip will usually engage the inner surface of the casing before the live slip travels the full range of travel.

The live slip recess may have a cylindrical piston housing which extends into the interior of the mandrel. The live recess may also have a pair of opposite facing arcuate slip shoulders with the piston housing disposed between the opposite facing slip shoulders. Each slip shoulder may have an arcuate groove facing the piston housing, where each arcuate groove defines a bend having a curvature which is concentric to the curvature of the cylindrical piston housing. The live slip is disposed within the arcuate grooves of the slip shoulders as generally described above, where the tabs of the live slip may have an arcuate end which generally corresponds to the curvature of the arcuate groove in which the tab is disposed. A piston is disposed within the cylindrical piston housing, where the piston is retained within the cylindrical piston housing by a piston engagement surface on the inward facing side of the live slip.

Also disclosed herein is a method of restraining axial motion of a string of tubing within the length of well casing.

In the method, a first part of a tubing string is run into the well, a hydraulic anchor as described above is made up into the tubing string by making the lower end of the anchor into the upper most end of the first part of the tubing string and making up the lower most end of a second part of the tubing string into upper end of the anchor and filling the tubing with liquid, causing the piston to drive the live slip outwardly into the inside wall of the casing.

DETAILED DESCRIPTION OF THE EMBODIMENTS

Figure 1:
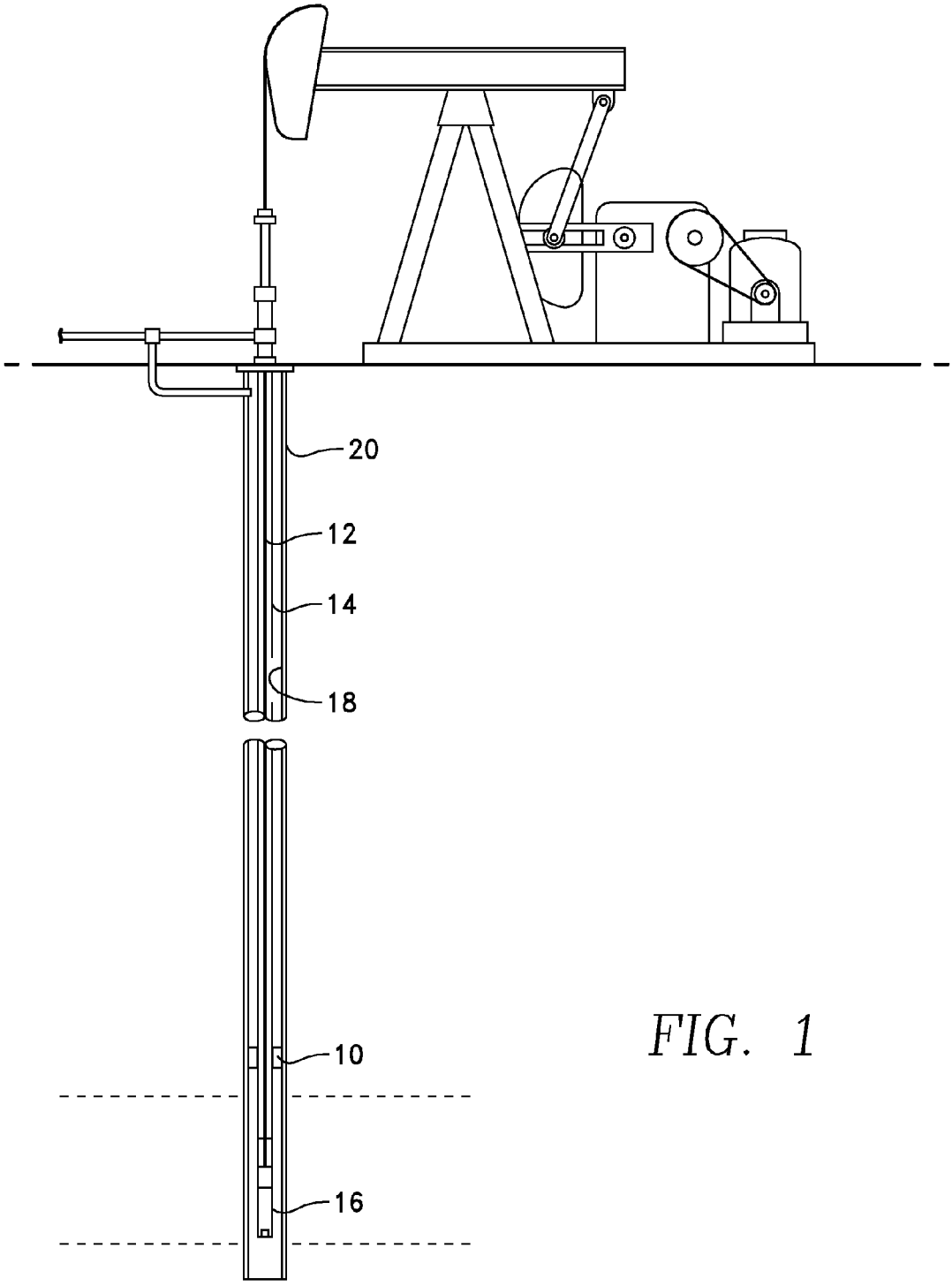
FIG. 1 shows a schematic view of a production system for a hydrocarbon producing well which might utilize embodiments of the present invention.

Referring specifically to the figures, FIG. 1 shows a schematic view of a production system for a hydrocarbon producing well, of the type in which embodiments of the present apparatus and method might be utilized. A hydraulic anchor 10 is schematically shown placed in a tubing string 14. A rod string 12 operates inside the tubing string 14 which reciprocates a plunger of a downhole pump 16. As the plunger is lifted upwards, the load of the fluid column contained in the tubing string 14 above the plunger is carried by the rod string 12. On the downstroke, the traveling valve inside the plunger opens and the load of the fluid column contained in the tubing is shifted to the tubing string 14. Unless the tubing string is anchored, the tubing string will stretch and contract in response to this cyclical loading. The hydraulic anchor 16 maintains the tubing string 14 in tension by the expansion of slips into the inside wall 18 of casing string 20.

Figure 2:
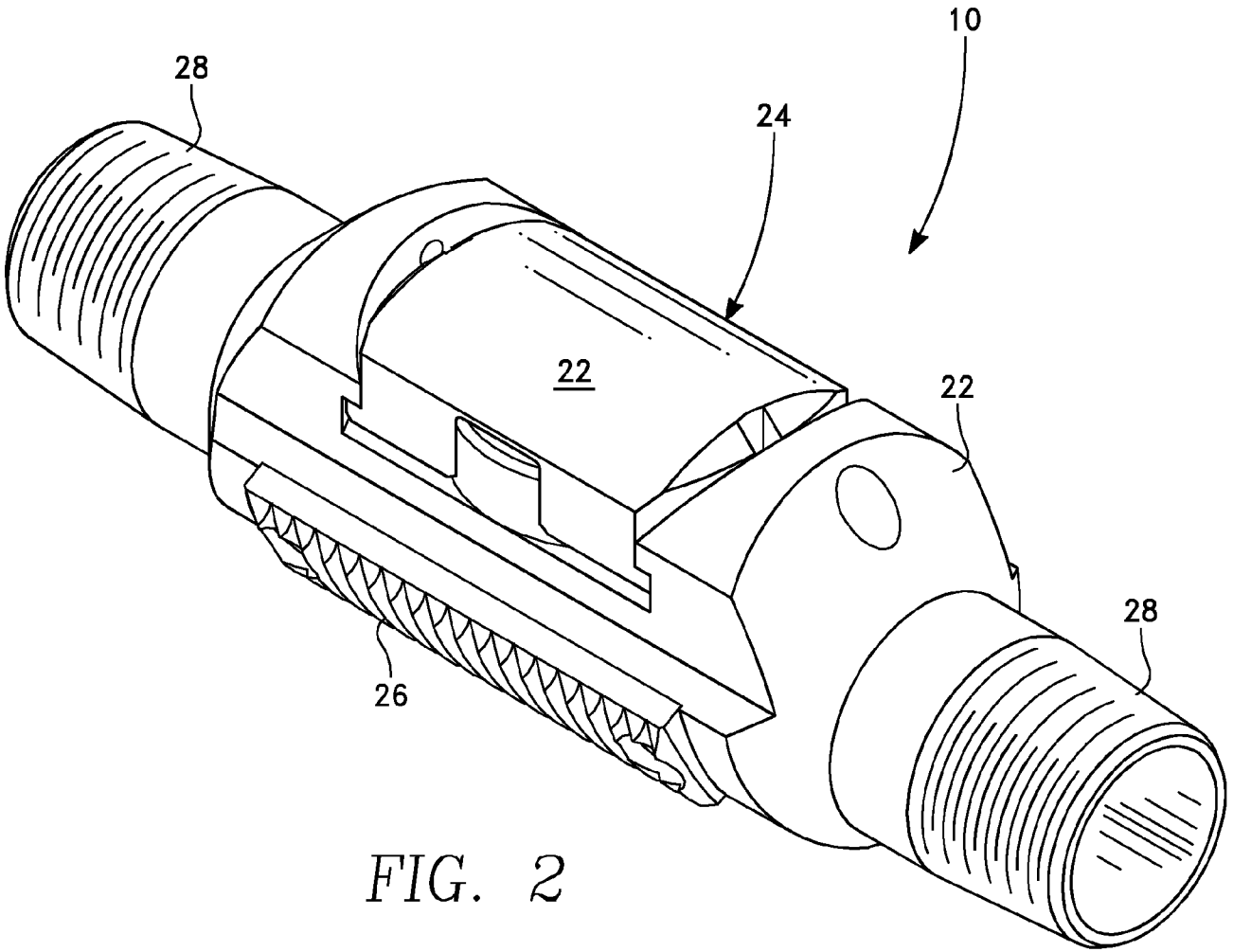
FIG. 2 shows a perspective view of an embodiment of the present invention.

FIG. 2 depicts an embodiment of the disclosed tubing anchor 10. The general components of the tubing anchor 10 are the mandrel 22, the live slip 24, fixed slip 26, and end connections 28.

Figure 3:
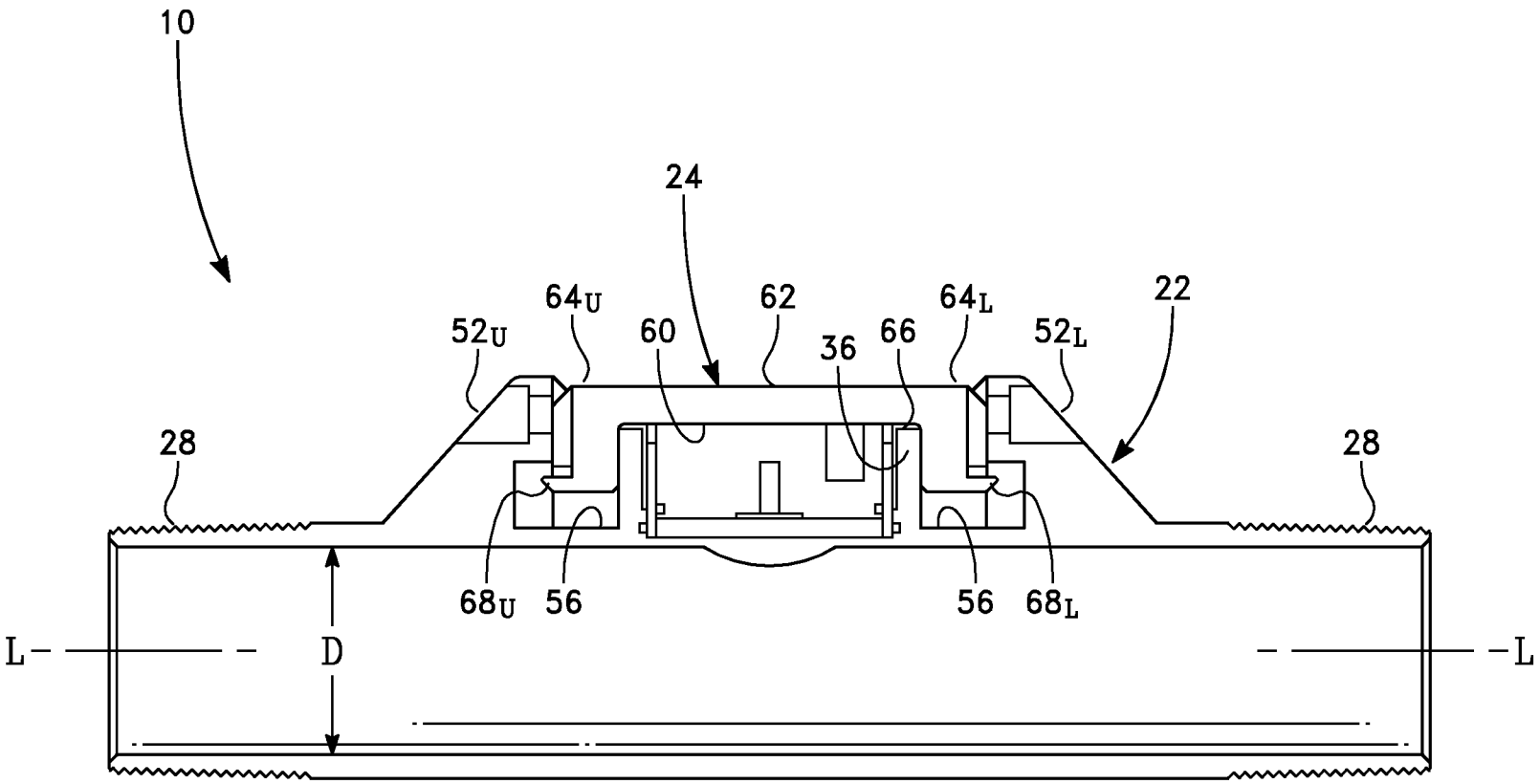
FIG. 3 shows a sectional view of an embodiment of the present invention.

FIG. 3 depicts a sectioned view of the tubing anchor 10 taken along its mid-line. As shown in this figure, the internal diameter D of the tubing anchor 10 may be full opening to allow the passage of any tool or device which will pass through the tubing. End connections 28 are depicted as threaded ends for making up into couplings of the tubing string 14. However, the mandrel 22 might be fabricated with female ends with internal threads as well, depending upon the requirements of the particular application.

Figure 4:
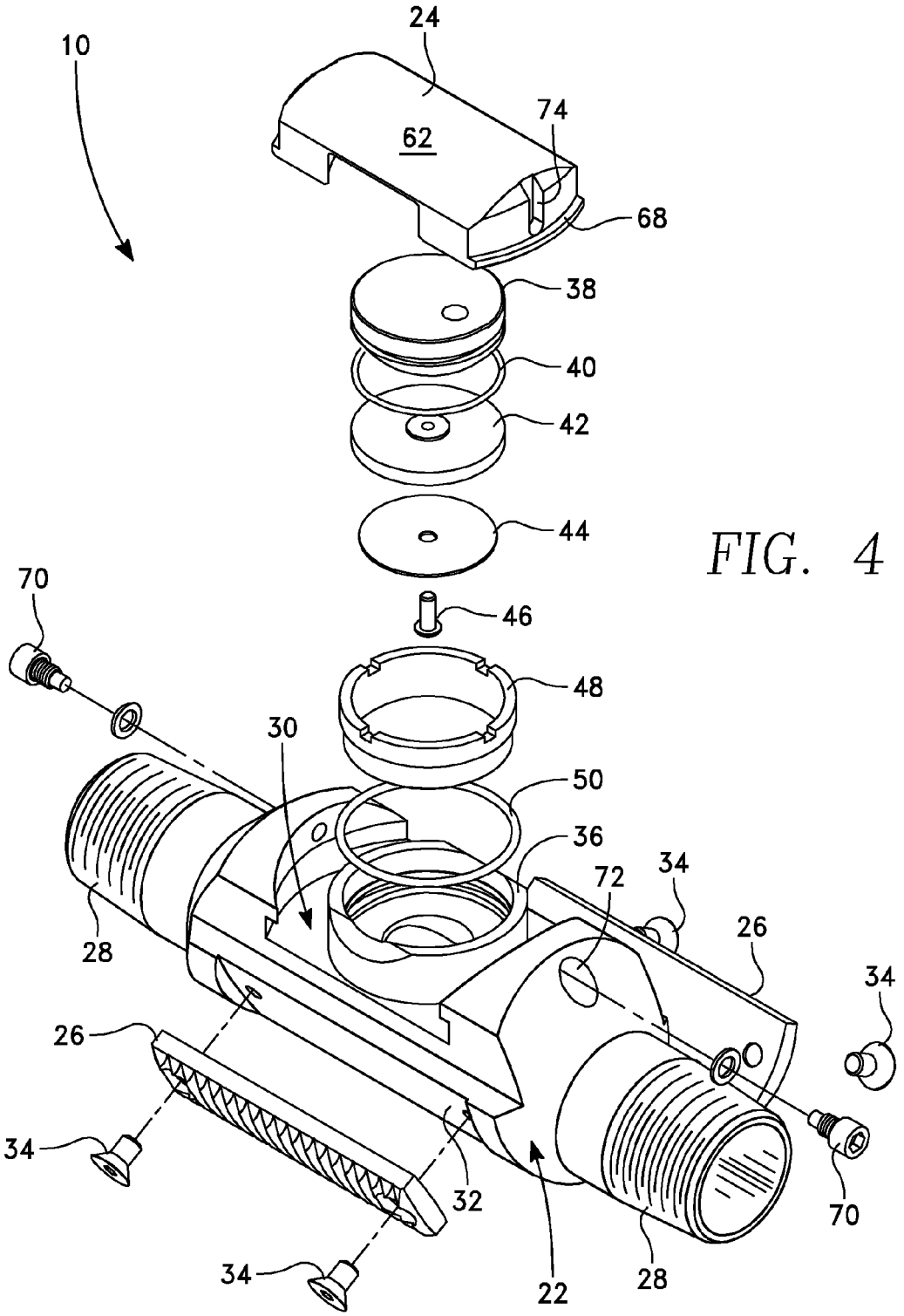
FIG. 4 shows an exploded view of an embodiment of the present invention.

FIG. 4 shows an exploded view of the tubing anchor 10. As shown in the figure, this embodiment comprises the mandrel 22, the live slip 24, fixed slips 26, and end connections 28. Live slip 24 fits into a live slip recess 30. Fixed slips 26 may be attached within fixed slip recesses 32 with fasteners 34. A cylindrical piston housing 36 is fashioned into the mid-section of the live slip recess 30. The cylindrical piston housing 36 extends into the interior of the mandrel 22 via aperture 74 which is defined by mandrel wall 76. A piston 38 is disposed within the cylindrical piston housing. Piston 38 is utilized to translate hydraulic pressure to a force which acts to urge live slip 24 outwardly to grip the inside diameter 18 of casing string 20. Although not shown in the figure, the outside facing surface 62 of live slip 24 which grips the inside diameter 18 of casing string 20 will typically have serrations or teeth which allow a secure bite into the inside surface of the casing. Piston 38 operates as a component of a unit which acts to utilize hydraulic pressure from the inside of the hydraulic 10 to exert an outward force on live slip 24, the unit comprising the piston 38, piston o-ring 40, seal cup 42, seal cup washer 44, cap screw 46, anchor sleeve 48 and anchor sleeve o-ring 50, the unit maintained within the cylindrical piston housing by the live slip 24 on the outside and the mandrel wall 76 on the inside.

Figure 5:
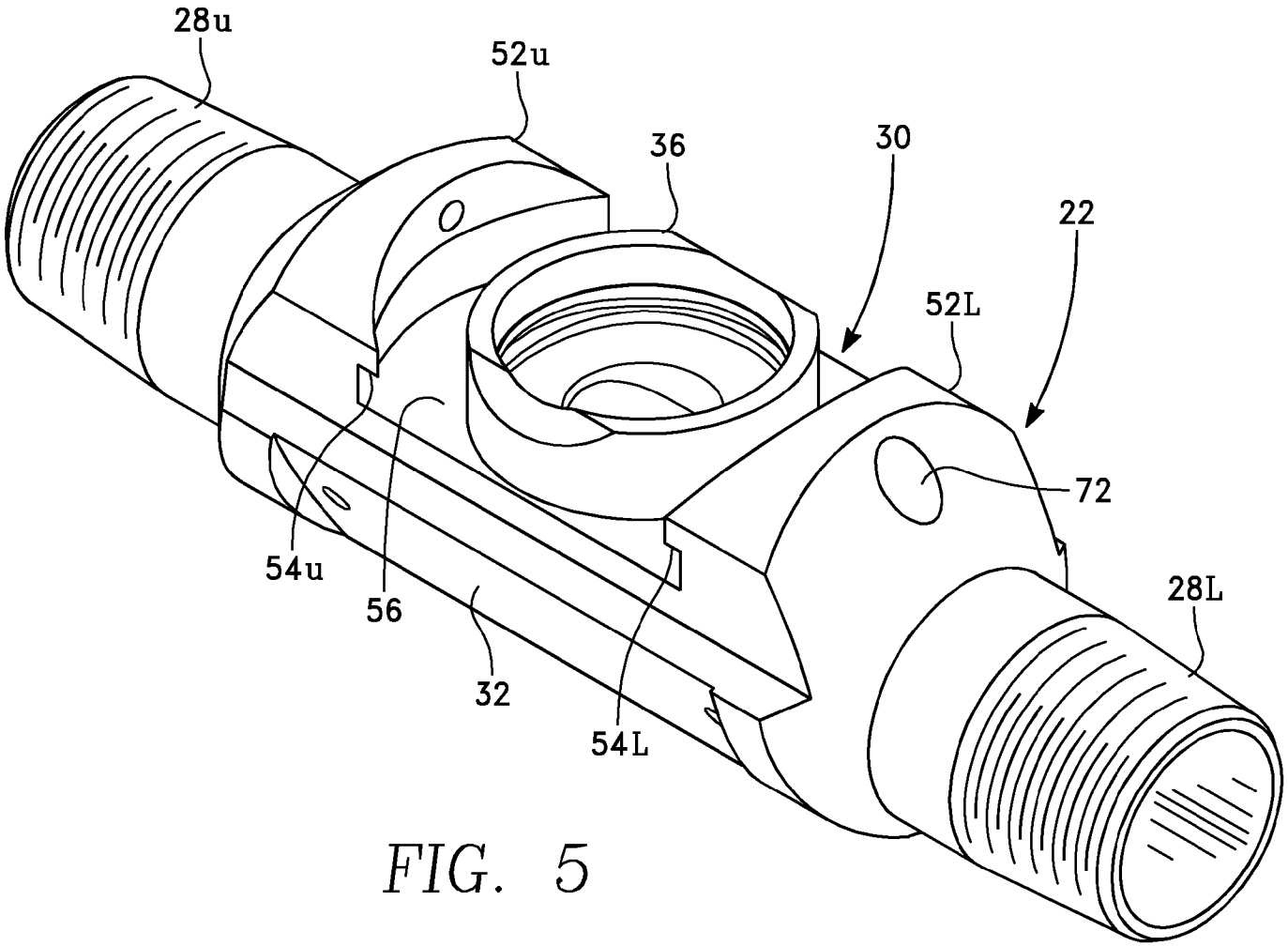
FIG. 5 shows a perspective view of an embodiment of a mandrel utilized in the present invention.
Figure 6:
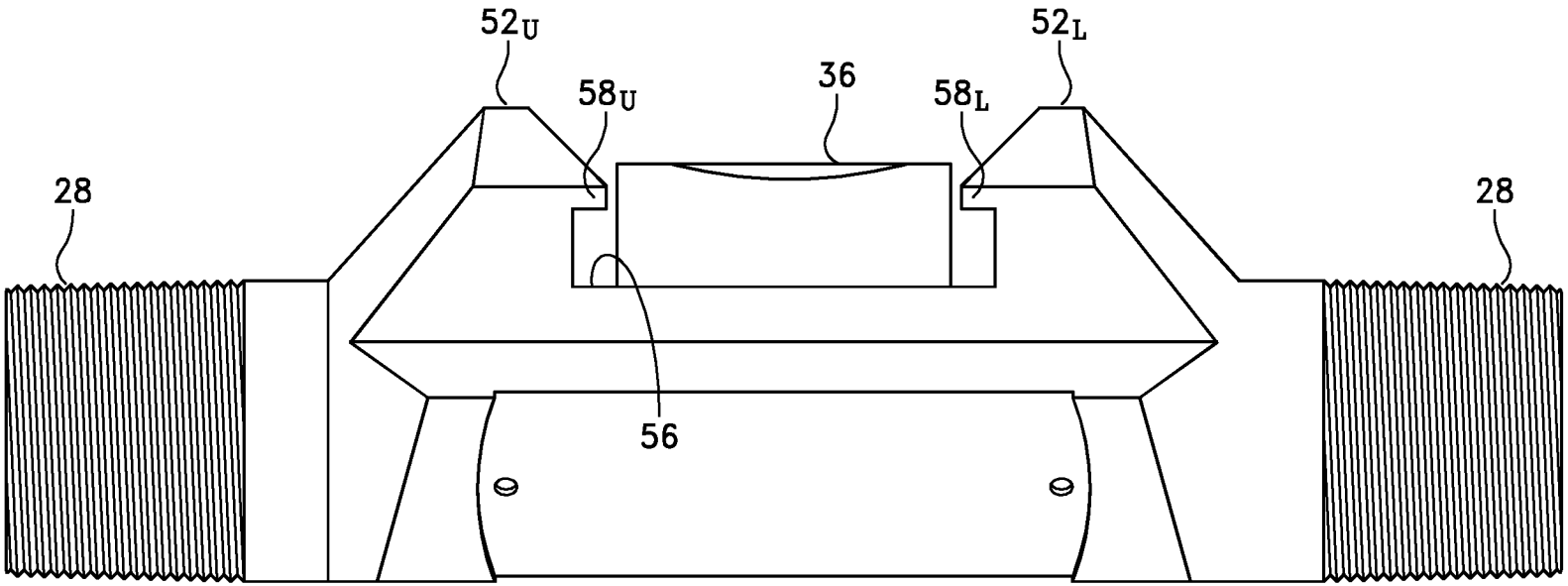
FIG. 6 shows a side view of the embodiment of the mandrel depicted in FIG. 5.

FIG. 5 depicts an embodiment of mandrel 22, showing the live slip recess 30 and the fixed slip recesses 32. It is assumed, for purposes of FIG. 5, that the upper end of mandrel 22 (i.e., the end facing toward the surface) is depicted at end $\mathbf{28}_U$ and the lower end of the mandrel is depicted at end $\mathbf{28}_L$. With respect to the upper end $\mathbf{28}_U$ and the lower end $\mathbf{28}_L$, the live slip recess 30 has an upper end which is defined by slip shoulder $\mathbf{52}_U$ and a lower end defined by slip shoulder $\mathbf{52}_L$ where the slip shoulders are opposite facing and the cylindrical piston housing 36 is disposed between the slip shoulders on a generally flat section 56, which forms the bottom of the live slip recess 30. Slip shoulder $\mathbf{52}_U$ and slip shoulder $\mathbf{52}_L$ respectively comprise grooves $\mathbf{54}_U$ and $\mathbf{54}_L$. Grooves 54U and 54L will generally have the same width, where the grooves define a bend which is concentric to the curvature of the cylindrical piston housing 36. As shown in FIG. 6, the upper slip shoulder $\mathbf{52}_U$ has a lip section $\mathbf{58}_U$ which overhangs the generally flat section 56, where groove $\mathbf{54}_U$ is defined between the lip section and the generally flat section. Likewise, the lower slip shoulder $\mathbf{52}_L$ has a lip section $\mathbf{58}_L$ which also overhangs the generally flat section 56, with groove $\mathbf{54}_L$ defined between the lip section and the generally flat section.

Live slip 24 is disposed within the live slip recess 30. The live slip 24 has an inward facing side 60, an outward facing side 62, an upper end $\mathbf{64}_U$ and a lower end $\mathbf{64}_L$. The inward facing side 60 has a piston engagement surface 66 which is in facing relation with the cylindrical piston housing 36. The upper end $\mathbf{64}_U$ and the lower end $\mathbf{64}_L$ respectively comprise axially extending tabs $\mathbf{68}_U$ and $\mathbf{68}_L$. Each of the axially extending tabs $\mathbf{68}_U$ and $\mathbf{68}_L$ are disposed within a corresponding arcuate groove $\mathbf{54}_U$ and $\mathbf{54}_L$ of the respective slip shoulders $\mathbf{52}_U$ and $\mathbf{52}_L$, where each tab has an arcuate end having a curvature generally corresponding to the curvature of the arcuate groove in which the tab is inserted.

As best seen in FIG. 3, the range of travel of the live slip 24 in a direction normal to the long axis L of the mandrel 22 is defined by the differences between the thickness of the tabs $\mathbf{68}_U$ and $\mathbf{68}_L$ with respect to the widths of arcuate groove $\mathbf{54}_U$ and $\mathbf{54}_L$, which are determined by the distance between the lip sections $\mathbf{58}_U$ and $\mathbf{58}_L$ and the generally flat section 56. Live slip 24 is generally retained within live slip recess 30 by fasteners 70 which extend through apertures 72 into slots 74 of the live slip, thereby allowing the outward travel of the live slip with respect to the live slip recess.

Figure 7:
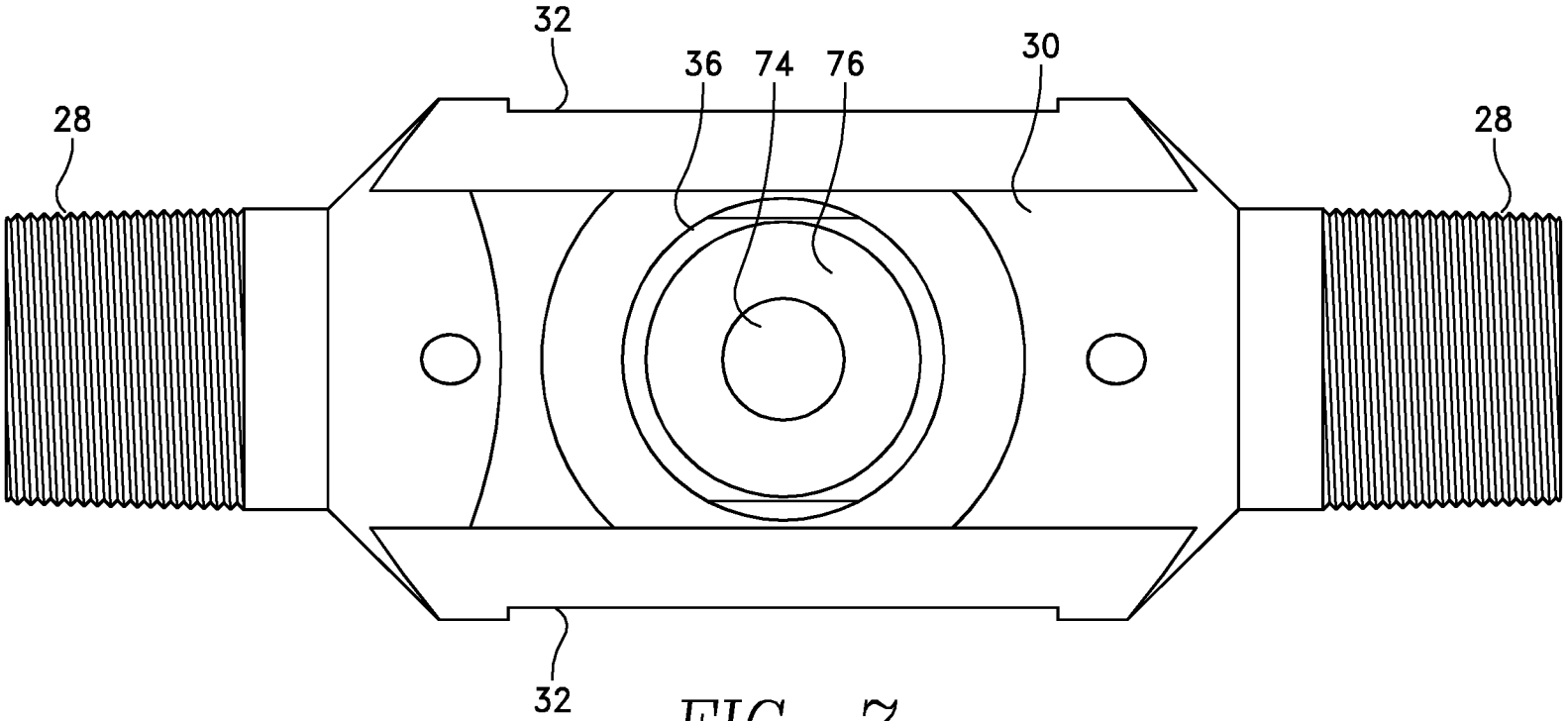
FIG. 7 shows a top view of the embodiment of the mandrel depicted in FIG. 5.
Figure 8:
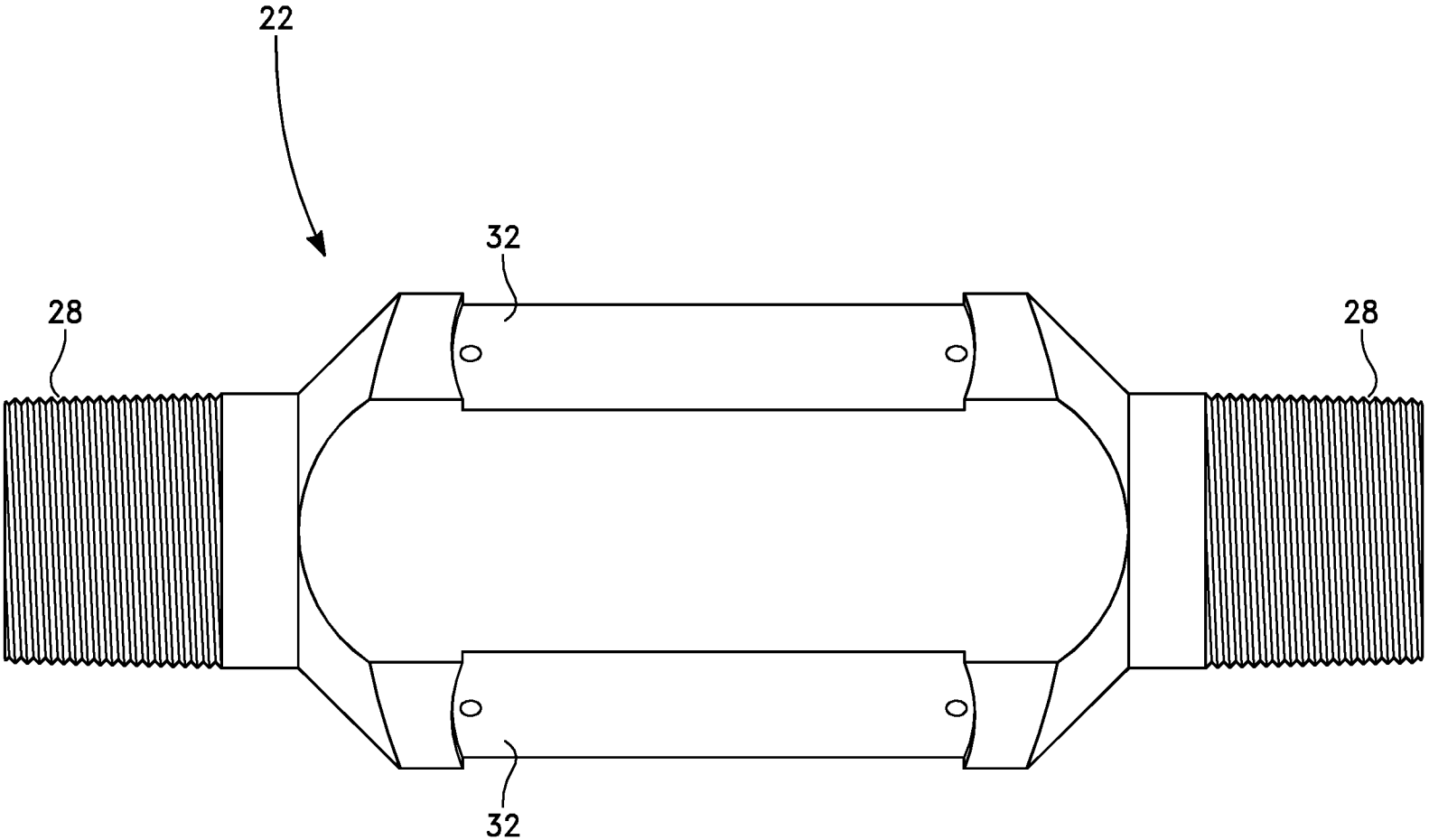
FIG. 8 shows a bottom view of the embodiment of the mandrel depicted in FIG. 5.
Figure 9:
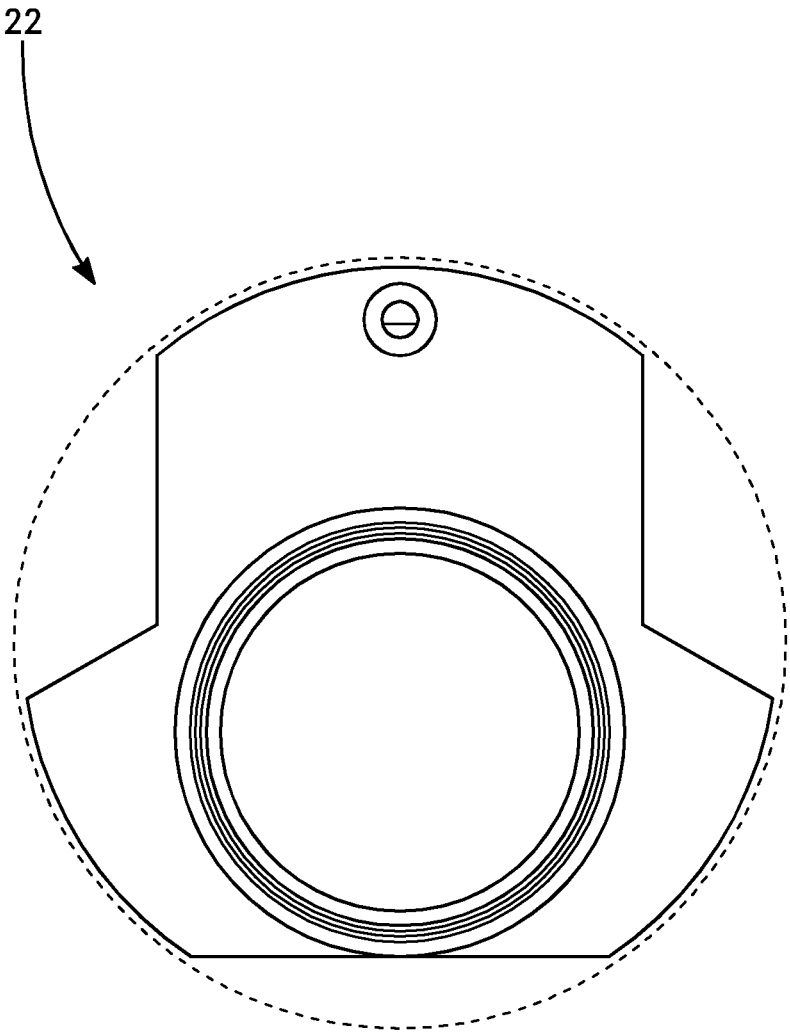
FIG. 9 shows a front/rear view of the embodiment of the mandrel depicted in FIG. 5.

An acceptable geometry of a mandrel 22 is depicted in FIGS. 7-9. As indicated in FIG. 9, the mandrel 22 may have a fluted body which allows the passage of gas and fluid past the outside of the anchor, in the annulus formed by the body of the anchor and the interior wall 18 of the casing string 20. As further shown in FIG. 9, the exterior of the mandrel 22 may define a circle and may, if necessary, be engaged by an overshot for emergency retrieval.

The anchor 10 is made up as a component of the tubing string 14, with the portion of the tubing comprising the downhole pump 16 placed below the anchor. For liner pumps, the pump liner will be made up as an integral part of the tubing string with the plunger installed on the end of the rod string 12. Alternatively, for insert pumps, the entire pump is run inside the tubing string 14 on the rod string 12. In either case, the internal diameter of anchor 10 should be at least as large as the inside diameter of the tubing string to allow passage of either the pump plunger or the insert pump 16. Once the anchor 10 is installed in the lower portion of the tubing string 14, the remainder of the tubing string is made up above the anchor. Once the tubing string is installed, the rod string 12 is made up and run inside of the tubing string with either a pump plunger or an insert pump 16 on the end of the rods. Once the rod string 12 and the tubing string 14 are installed, the tubing string is filled with fluid. Once the fluid level inside the tubing string 14 is higher (i.e., closer to the surface) than the fluid level inside the casing string 20, assuming fluids of equivalent density, piston 38 will start imposing an outward force against live slip 24 until a maximum hydraulic force is reached when the liquid level inside the tubing string 14 reaches the surface.

The hydraulic force is removed by draining the tubing string 14 of fluid by either activating a drain in the tubing string 14, pulling the pump 16 off seat, or cutting a hole in the tubing. Because of the interactive structures of the live slip 24 and the live slip recess 30, the live slip will be maintained disposed within the live slip recess, avoiding the problems otherwise presented when a live slip parts from the anchor.

While the above is a description of various embodiments of the present invention, further modifications may be employed without departing from the spirit and scope of the present invention. Thus the scope of the invention should not be limited according to these factors, but according to the following appended claims.

What is claimed is:

1. In a hydrocarbon producing well having a length of well casing, a device restrains axial motion of a string of tubing within the length of well casing, the device comprising:

a mandrel having an upper end, a lower end, and a plurality of axially oriented slip recesses spaced circumferentially about the mandrel, the slip recesses comprising a fixed slip recess and a live slip recess;

a fixed slip attached within the fixed slip recess, and a live slip disposed within the live slip recess;

the live slip recess comprising, with respect to the upper end and lower end of the mandrel, an upper end and a lower end, a first groove in the upper end and a second groove in the lower end, the first groove having a first width and the second groove having a second width, the live slip recess further comprising a cylindrical piston housing;

the live slip comprising a top end and a bottom end, the top end comprising a first axially extending tab and the bottom end comprising a second axially extending tab, wherein the first axially extending tab is disposed within the first groove and the second axially extending tab is disposed within the second groove; and the first axially extending tab having a first thickness and the second axially extending tab having a second thickness wherein a range of travel of the live slip normal to a long axis of the mandrel is defined by the difference between the first width and the first thickness and the difference between the second width and the second thickness.

2. The device of claim 1 wherein the live slip recess further comprises a pair of opposite facing arcuate slip shoulders, the cylindrical piston housing disposed between the opposite facing arcuate slip shoulders.

3. The device of claim 2 wherein a first slip shoulder comprises the first groove and a second slip shoulder comprises the second groove.

4. The device of claim 3 wherein the first groove and the second groove define a bend having a curvature concentric to the curvature of the cylindrical piston housing.

5. The device of claim 1 wherein the mandrel comprises a fluted exterior surface.

6. In a hydrocarbon producing well having a length of well casing, a device restrains axial motion of a string of tubing within the length of well casing, the device comprising:

a mandrel having an upward end and a downward end, wherein an axis is defined between the upward and the downward end, the mandrel adapted to be installed in-line in the string of tubing;

the mandrel comprising a continuous axial opening between the upper end and the downward end, the mandrel further comprising an exterior having a plurality of axially oriented slip recesses spaced circumferentially about the exterior, the slip recesses comprising at least two fixed slip recesses and a live slip recess, the live slip recess comprising an interior;

a fixed slip attached within each of the at least two fixed slip recesses;

the live slip recess comprising a cylindrical piston housing extending into the interior, the live slip recess further comprising a pair of opposite facing arcuate slip shoulders, the piston housing disposed between the opposite facing slip shoulders, wherein each slip shoulder comprises a arcuate groove facing the piston housing, each arcuate groove defining a bend having a curvature concentric to the curvature of the cylindrical piston housing;

a live slip disposed within the live slip recess, the live slip comprising an inward facing side, an outward facing side, an upper end and a lower end, wherein the inward facing side comprises a piston engagement surface in facing relation with the cylindrical piston housing and the upper end and the lower end each comprise an axially extending tab, each axially extending tab disposed within a corresponding arcuate groove of the respective slip shoulder, wherein each tab has an arcuate end having a curvature generally corresponding to the curvature of the arcuate groove in which the tab is disposed; and a piston disposed within the cylindrical piston housing, where the piston is retained within the cylindrical piston housing by the piston engagement surface of the live slip.

7. The device of claim 6 wherein the mandrel comprises a fluted exterior surface.

8. The device of claim 7 wherein the exterior of the mandrel defines a circle.

9. The device of claim 6 wherein the piston operates as a piston unit comprising the piston, a seal cup, an anchor ring, and an o-ring.

10. In a hydrocarbon producing well having a length of well casing, a method for restraining axial motion of a string of tubing within the length of well casing, the method comprising:

installing a first part of the string of tubing into the well;

making up a tubing anchor in-line with the string of tubing;

installing a second part of the string of tubing into the well;

filling the string of tubing with liquid;

wherein the tubing anchor comprises (i) a mandrel having an upper end, a lower end, and a plurality of axially oriented slip recesses spaced circumferentially about the mandrel, the slip recesses comprising a fixed slip recess and a live slip recess wherein the live slip recess comprises a cylindrical piston housing; (ii) a fixed slip attached within the fixed slip recess, and the live slip disposed within the live slip recess; (iii) the live slip recess comprising, with respect to the upper end and lower end of the mandrel, an upper end and a lower end, a first groove in the upper end and a second groove in the lower end, the first groove having a first width and the second groove having a second width; (iv) the live slip comprising a top end and a bottom end, the top end comprising a first axially extending tab and the bottom end comprising a second axially extending tab, wherein the first axially extending tab is disposed within the first groove and the second axially extending tab is disposed within the second groove; and (v) the first axially extending tab having a first thickness and the second axially extending tab having a second thickness and a range of travel of the live slip normal to a long axis of the mandrel is defined by the first thickness with respect to the first width and the second thickness with respect to the second width.

11. The method of claim 10 comprising the further step of installing a rod string and a pump.

12. The method of claim 10 wherein the live slip recess further comprises a pair of opposite facing arcuate slip shoulders, the cylindrical piston housing disposed between the opposite facing arcuate slip shoulders.

13. The method of claim 12 wherein a first slip shoulder comprises the first groove and a second slip shoulder comprises the second groove.

14. The method of 13 wherein the first groove and the second groove define a bend having a curvature concentric to the curvature of the cylindrical piston housing.

15. The method of claim 14 wherein the mandrel comprises a fluted exterior surface.

16. In a hydrocarbon producing well having a length of well casing, a device restrains axial motion of a string of tubing within the length of well casing, the device comprising:

a mandrel having an exterior, an interior, an upper end, a lower end, and a plurality of axially oriented slip recesses spaced circumferentially about the exterior of the mandrel, the slip recesses comprising a fixed slip recess and a live slip recess;

a fixed slip attached within the fixed slip recess, and a live slip disposed within the live slip recess;

the live slip recess comprising, a generally flat section disposed between an upper arcuate slip shoulder and a lower arcuate slip shoulder, the upper arcuate slip shoulder and the lower arcuate slip shoulder in facing relation;

a cylindrical piston housing disposed on the generally flat section, the cylindrical piston housing having a circular opening extending into the interior;

the upper arcuate slip shoulder comprising a first arcuate lip section which overhangs the generally flat section, wherein a first groove is defined between the first arcuate lip section and the generally flat section;

the lower arcuate slip shoulder comprising a second arcuate lip section which overhangs the generally flat section, wherein a second groove is defined between the second arcuate lip section and the generally flat section;

the live slip comprising an outwardly facing surface and inwardly facing surface, the inwardly facing surface comprising a piston engagement surface, the live slip further comprising a top end and a bottom end, the top end comprising a first axially extending tab and the bottom end comprising a second axially extending tab, wherein the first axially extending tab is disposed within the first groove and the second axially extending tab is disposed within the second groove; and a piston disposed within the cylindrical piston housing, where the piston is retained within the cylindrical piston housing by the piston engagement surface of the live slip.

17. The device of claim 16 wherein the first groove has a first width and the second groove has a second width, and the first axially extending tab has a first thickness and the second axially extending tab has a second thickness and a range of travel of the live slip normal to a long axis of the mandrel is defined by the first thickness with respect to the first width and the second thickness with respect to the second width.

18. The device of claim 16 wherein each groove defines a bend having a curvature concentric to the cylindrical piston housing.

* * * * *